US008092616B2

(12) United States Patent
Furuya et al.

(10) Patent No.: US 8,092,616 B2
(45) Date of Patent: Jan. 10, 2012

(54) METHOD FOR PRODUCING A GIANT MAGNETOSTRICTIVE ALLOY

(75) Inventors: Yasubumi Furuya, Miyagi (JP); Teiko Okazaki, Aomori (JP); Chihiro Saito, Aomori (JP); Masaki Yokoyama, Aomori (JP); Mamoru Oomori, Miyagi (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 134 days.

(21) Appl. No.: 12/551,760

(22) Filed: Sep. 1, 2009

(65) Prior Publication Data

US 2010/0006183 A1 Jan. 14, 2010

Related U.S. Application Data

(62) Division of application No. 10/598,767, filed as application No. PCT/JP2004/014963 on Oct. 8, 2004, now abandoned.

(30) Foreign Application Priority Data

Mar. 11, 2004 (JP) ..... 2004-069787

(51) Int. Cl.
*H01F 1/147* (2006.01)
*H01F 1/22* (2006.01)

(52) U.S. Cl. ..... 148/104; 148/306; 148/121; 419/48

(58) Field of Classification Search ..... None
See application file for complete search history.

(56) References Cited

U.S. PATENT DOCUMENTS

| | | | | |
|---|---|---|---|---|
| 6,312,530 | B1 * | 11/2001 | Kojima et al. | 148/301 |
| 2001/0018938 | A1 * | 9/2001 | Arai et al. | 148/301 |
| 2003/0010405 | A1 | 1/2003 | Clark et al. | |

FOREIGN PATENT DOCUMENTS

| | | | |
|---|---|---|---|
| JP | 1-212728 | A | 8/1989 |
| JP | 2-125802 | A | 5/1990 |
| JP | 3-115540 | A | 5/1991 |
| JP | 5-105992 | A | 4/1993 |
| JP | 6-172886 | A | 6/1994 |
| JP | 7-216409 | A | 8/1995 |
| JP | 11-189852 | A | 7/1999 |
| JP | 11-269611 | A | 10/1999 |

(Continued)

OTHER PUBLICATIONS

Abstract of: Saito et al., Bulky Material Process Based on Rapid Solidified Magnetostricive GALFENOL, 2003.*

(Continued)

*Primary Examiner* — John Sheehan
(74) *Attorney, Agent, or Firm* — Westerman, Hattori, Daniels & Adrian, LLP

(57) ABSTRACT

A rapidly solidified Fe—Ga alloy containing 15 to 23 atomic percent of Ga having a particular rapidly solidified texture is formed into slices which are laminated to each other in a die, or is formed into a powder or chops which are filled in the die. Subsequently, spark plasma sintering is performed so that bonds between the slices, grains of the powder, or the chops are formed at a high density to form a bulk alloy and the rapidly solidified texture is not lost, followed by annealing whenever necessary, so that a magnetostriction of 170 to 230 ppm at room temperature is obtained.

3 Claims, 4 Drawing Sheets

FOREIGN PATENT DOCUMENTS

| | | | |
|---|---|---|---|
| JP | 2001-358377 | A | 12/2001 |
| JP | 2000-34502 | A | 2/2002 |
| JP | 2003-96529 | A | 4/2003 |
| JP | 2003-286550 | A | 10/2003 |

OTHER PUBLICATIONS

Abstract of: Saito et al., Bulky Material Process Based on Rapid Solidified Magnetostricive GALFENOL, 2004.*

C. Saito et al., "Rapid—solidified bulk process and magnetostrictive properties of GALFENOL", The Japan Institute of Metals, Oct. 11, 2003, p. 354, No. 133. cited in International search report.

M. Yokoyama et al., "Verification of the bulk solidification process based on the rapid solidification of shape memory alloy (SMA) actuator/sensor material and its characteristics", The Japan Institute of Metals, Oct. 11, 2003, p. 351, No. 133. cited in International search report.

Y. Furuya et al., "Large Magnetostriction in Fe-Ga Rapid-Solidified Alloy", The Japan Institute of Metals, 2002, pp. 901-904, vol. 66, No. 9.

T. Yamahira et al., "Shape Memory Characteristics of Thermoelastic TiNi System Rapid-Solidified Fibers", The Japan Institute of Metals, 2002, pp. 909-912, vol. 66, No. 9.

M. Omori, "Sintering, consolidation, reaction and crystal growth by the spark plasma system (SPS)", Materials Science and Engineering, 2000, pp. 183-188, A287. Cited in the Specification.

K. Yamazaki et al., "Super-High Strength Shape Memory Thin Films", pp. 235-249, ICOMAT-2000.

C. Saito et al., "Microstructure and Magnetostriction of Rapid-Solidified Fe-15 at %Ga Alloy", Material Transactions, 2004, pp. 193-198, vol. 45, No. 2. Cited in the Specification.

International Search Report of PCT/JP2004/014963, dated Jan. 11, 2005.

Furuya et al., International Preliminary Report on Patentability of PCT/JP2004/014963 dated Feb. 17, 2006.

* cited by examiner

METHOD FOR PRODUCING A GIANT MAGNETOSTRICTIVE ALLOY

CROSS-REFERENCE TO RELATED APPLICATIONS

This is a divisional application of U.S. patent application Ser. No. 10/598,767, filed on Sep. 11, 2006, currently pending, which is a 371 of International Application No. PCT/JP2004/014963, filed on Oct. 8, 2004, which claims the benefit of priority from the prior Japanese Patent Application No. 2004-069787, filed on Mar. 11, 2004, the entire contents of which are incorporated herein by references.

TECHNICAL FIELD

The present invention relates to a method for producing a giant magnetostrictive alloy, the alloy is used as a material for sensor and actuator elements.

BACKGROUND ART

By using a liquid rapid solidification method, various amorphous, fine crystalline, and polycrystalline alloy-based materials have been developed. Functional materials, such as a shape-memory alloy, in the form of a thin belt, a thin wire, and a powder can be formed by a liquid rapid solidification method (Patent Documents 1 and 2).

As for an iron-based magnetic shape-memory alloy, one (Furuya) of the inventors of the present invention found a giant magnetostrictive effect by using a liquid rapid solidification method which is equivalent to the level of Terfenol-D known as a giant magnetostrictive material. This new magnetostrictive material is a practical polycrystalline material having a particular crystal controlled texture which is fine and has strong directionality peculiar to a rapidly solidified material, and a patent application relating to a polycrystalline Fe—Pd-based and a Fe—Pt-based alloy was filed (Patent Document 3). In addition, the inventors of the present invention reported properties of a thin belt-shaped sample of a Fe-15 at % Ga alloy which was annealed for a short period of time (1,173K for 0.5 hour) (Non-Patent Document 1).

Furthermore, it was also found that when a NiCoGa, a CoNiGa-based alloy (Patent Document 4) and a Fe—Ga-based alloy (Patent Document 5) are processed at a certain rapid cooling rate, a fine columnar crystal texture having significantly strong crystalline anisotropy can be formed, and that the material thus controlled also has ductility and can induce a magnetostrictive phenomenon 6 to 10 times or more that of a conventional randomly oriented crystalline material.

However, an alloy having high performances as described above has been realized primarily by a thin belt or a thin wire having a thickness or a diameter of approximately 200 μm or less, and it has been difficult to obtain a material having predetermined properties by a melt method. Heretofore, as a method for producing a bulk crystalline alloy in the form of a plate, a bar, or the like having a thickness or a diameter in the order of millimeters or more, besides a melt method, a powder metallurgical method has been known. As one powder metallurgical method, a spark plasma sintering method has been known (for example, see Non-Patent Document 2 and Patent Document 6).

In the spark plasma sintering method, high energy pulses can be concentrated on positions at which intergranular bonds are intended to be formed, and hence a sintering process dynamically proceeds. This is the feature of the spark plasma sintering process and is significantly different from a general quasi-static sintering method such as hot pressing or resistance sintering. Since rapid temperature increase only on grain surfaces can be performed by self-heating, while the grain growth of a sintering raw material is suppressed, a dense sintered body can be obtained within a short period of time. In addition, since the texture inside the sintering raw material can be prevented from being changed, a powdered material having an amorphous structure or a nanocrystalline texture can be formed into a bulk shape such as a plate or a bar while maintaining its own structure or texture. By using this electrical spark plasma sintering method, a Fe—Dy—Tb-based or a rare earth element-transition metal-based giant magnetostrictive material formed into a desired shape has been developed (Patent Documents 7, 8, and 9).

Patent Document 1: Japanese Unexamined Patent Application Publication No. 1-212728 (Japanese Patent No. 2589125)

Patent Document 2: Japanese Unexamined Patent Application Publication No. 6-172886

Patent Document 3: Japanese Unexamined Patent Application Publication No. 11-269611

Patent Document 4: Japanese Unexamined Patent Application Publication No. 2003-96529

Patent Document 5: Japanese Unexamined Patent Application Publication No. 2003-286550

Patent Document 6: Japanese Unexamined Patent Application Publication No. 7-216409 (Japanese Patent No. 2762225)

Patent Document 7: Japanese Unexamined Patent Application Publication No. 5-105992

Patent Document 8: Japanese Unexamined Patent Application Publication No. 11-189853

Patent Document 9: Japanese Unexamined Patent Application Publication No. 2001-358377

Non-Patent Document 1: authored by C. Saito, Y. Furuya, T. Okazaki, T. Watanabe, T. Matsuzaki, and M. Wuttig, Mater. Trans., JIM, vol. 45, pp. 193 to 198, Feb. (2004).

Non-Patent Document 2: authored by M. Omori, Mater. Sci. Eng. A, vol. 287, pp. 183 to 188, Aug. (2000).

DISCLOSURE OF INVENTION

Problems to be Solved by the Invention

A rapidly solidified material produced by a liquid rapid solidification method has superior performance; however, because of restrictions by the rapid cooling process, the material thus obtained has a very small thickness or diameter such as a plate material having a thickness of approximately not more than 100 μm or a wire material having a diameter of approximately not more than 100 μm. In addition, the maximum length of the rapidly solidified material thus produced is approximately 2 m, and a material having a considerably large length is difficult to be produced. When the materials described above are used, an actuating force thereof as an actuator element is small, and the application of the materials is limited only to micromachines and small sensor devices. In addition, since superior properties because of a non-equilibrium phase and a fine crystalline texture peculiar to a rapidly solidified material disappear when it is annealed for a long period of time, the improvement in alloy properties by annealing is limited.

Heretofore, as for an iron-based Fe—Ga magnetostrictive alloy, development by a single crystal method was performed only in USA (by the Office of Naval Research, ONR), and a magnetostriction of 300 ppm was reported. However, the singly crystal method must be carried out under very severe operation conditions, and in addition, single crystal actuator and sensor materials are disadvantageously very expensive.

Accordingly, as a material used for actuator and sensor elements incorporated in mechanical and electronic components and in intelligent material systems and structures (aircrafts, automobiles, constructive structures, sonar devices, electric devices) of industrial application fields, development of bulk materials and that of production methods thereof have been desired, the bulk materials having workability to be formed into a complicated shape and having a large mass so as to obtain a large recovery force.

An object of the present invention is to produce a bulk material suitably used as a material for actuator and sensor elements from a Fe—Ga-based magnetostrictive alloy taking advantage of crystal miniaturization and anisotropy as well as reduction in precipitates (equilibrium phase in state diagram) and non-equilibrium phases peculiar to liquid rapidly solidified materials, and to obtain performance enhancement by a production method superior to the melt method in terms of cost.

The present invention provides a bulk alloy having a mass to a certain extent while superior properties of a liquid rapidly solidified material are maintained. According to the present invention, a bulk alloy is formed by stacking slices in a die, which are formed from a rapidly solidified material having a particular rapidly solidified texture of a Fe—Ga magnetostrictive alloy and superior properties based on the above texture, or filling a powder or chops of the rapidly solidified material in the die, followed by performing a spark plasma sintering method, so as to generate bonds between the slices, grains of the powder, or the chops at a high density. In addition, according to the present invention, the bulk alloy thus sintered is further annealed, so that the properties thereof are improved.

That is, the present invention is as follows:

(1) a method for producing giant magnetostrictive alloy, comprising the steps of: forming a rapidly solidified material by a liquid rapid solidification method from a Fe—Ga alloy having a high temperature-side disordered bcc structure and a fine columnar texture, being in a disordered to an ordered transition composition range, and containing 15 to 23 atomic percent of Ga with respect to polycrystalline Fe; forming slices, a powder, or chops from the alloy as a raw material; and performing spark plasma sintering of the raw material at an application pressure of 50 MPa or more and at a sintering temperature of 873K or more under conditions in which the pressure and the temperature are controlled so that the texture of the rapidly solidified material is not lost;

(2) the method for producing a giant magnetostrictive alloy for actuators and sensors, according to the above (1), wherein annealing is performed after the sintering to obtain a magnetostriction of 170 to 230 ppm at room temperature; and (3) the method for producing a giant magnetostrictive alloy for actuators and sensors, according to the above (2), wherein the crystal orientation of alloy properties is enhanced by annealing in a magnetic field after the sintering, and the magnetic moment (magnetic domain structure) directly relating to the magnetostriction is controlled.

Advantages

The new bulk rapidly solidified Fe—Ga magnetostrictive alloy according to the present invention can obtain approximately 80% of magnetostriction of a single crystalline magnetostrictive alloy, is significantly inexpensive (approximately one twentieth) as compared to the conventional rare earth-based Terfenol-D, and also has superior workability (ductility) and high rigidity. Accordingly, a rising strain energy density at an initial magnetization stage can be increased. In addition, according to the method of the present invention, rapidly solidified materials can be formed into a bulk shape by a mass production process.

BEST MODE FOR CARRYING OUT THE INVENTION

Figure 1:
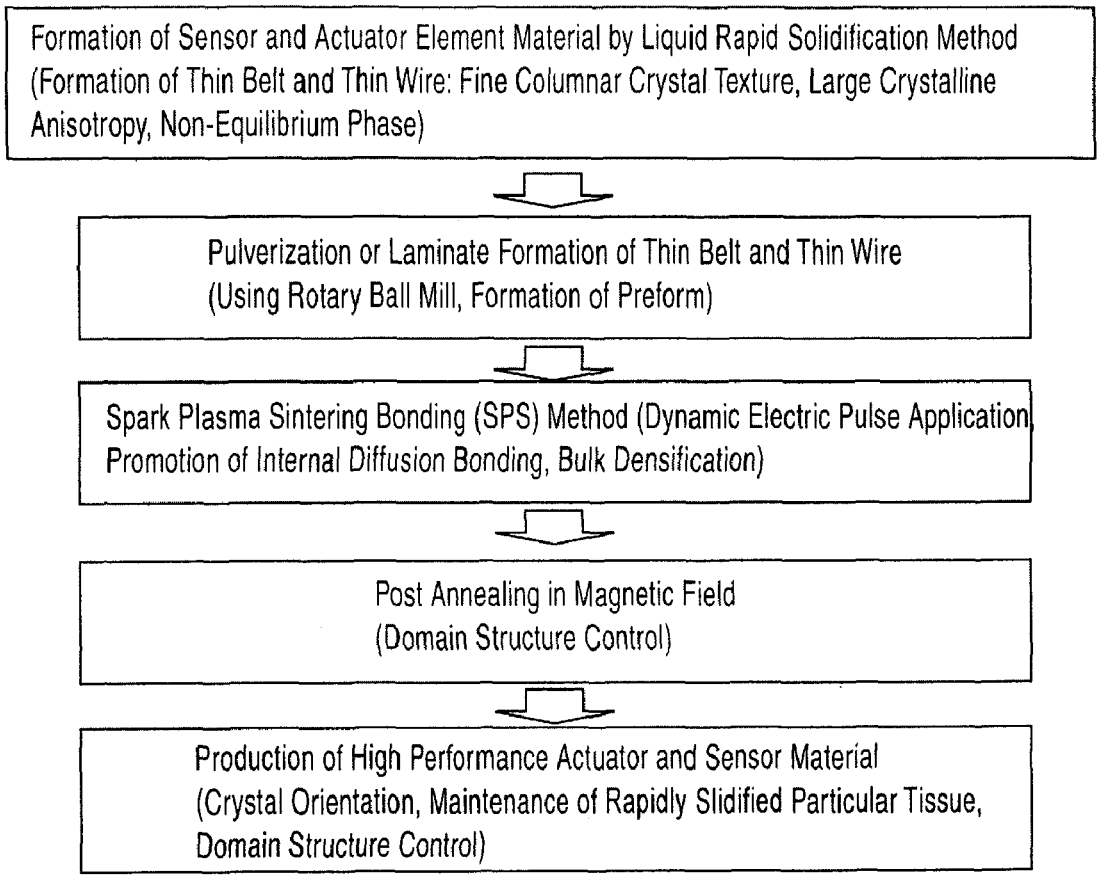
FIG. 1 is a flowchart of a method for producing a rapidly solidified material consolidated into a bulk form according to the present invention.

FIG. 1 shows steps of a method for producing a rapidly solidified material consolidated into a bulk form according to the present invention. A material for sensor and actuator elements is first formed by a liquid rapid solidification method. An ingot as a raw material is formed into a thin belt (ribbon) by a high-frequency induction melting-liquid rapid solidification method (twin roll or single roll quenching method). Alternatively, a thin wire (fiber) is formed by plasma arc melting-melt extraction rapid solidification method (conical-roll front-end spinning method). Accordingly, a rapidly solidified material having a fine columnar crystal texture, large crystalline anisotropy, and non-equilibrium phase and the like can be obtained.

A liquid rapid solidification method is frequently used as a method for producing an amorphous alloy and is also effectively used when a material having poor workability, such as a Fe—Ga magnetostrictive alloy, is formed into a sheet having a thickness of 20 to 30 μm. In a liquid rapidly solidified alloy, because of crystal miniaturization having a nano- to micron-size scale and columnar crystal (anisotropy) formation, functional performances such as durability, ductility, magnetostrictive effect, and shape-memory effect can be improved.

Next, when the shape of a rapidly solidified material is a slice having a length of approximately 20 to 50 mm and a thickness of 20 to 30 μm, a perform is formed by stacking the slices in a die without pulverization and then can be sintered. When the shape of a rapidly solidified material is a long and thin belt, the material is cut to have a size approximately equivalent to that of the above slice to form a sintering raw material.

When a rapidly solidified material in the form of a thin belt or a thin wire is pulverized into a powder, wet pulverization is performed using rotary ball milling, that is, pulverization is performed while thin belts or thin wires are immersed in alcohol such as ethanol, so that a powder or chops are obtained. For the pulverization, a method using a planetary ball milling machine is preferable. This is a method in which a powder can be obtained within a short period of time by using centrifugal forces of balls and mechanical energy with a wall of a container.

Figure 2:
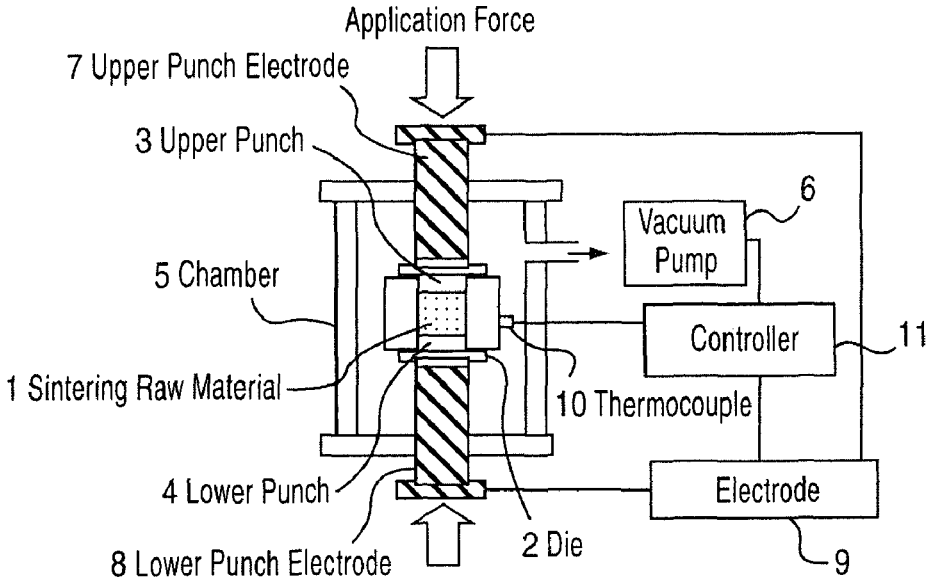
FIG. 2 is a schematic view of a spark plasma sintering apparatus.

Next, the powder or chops obtained by pulverization is filled in a die to form a preform. The sintering raw material laminated and placed in the die or that is filled therein is processed by spark plasma sintering. As shown in FIG. 2, the spark plasma sintering is performed by filling a sintering raw material 1 in a cemented carbide alloy die 2, and applying a pressure by pushing an upper punch 3 and a lower punch 4 therein. After those are fixed on a sintering stage (not shown) in a chamber 5, and the inside of the chamber 5 is evacuated by a vacuum pump 6, the sintering raw material 1 is sandwiched by an upper punch electrode 7 and a lower punch electrode 8, and pulse electricity is applied from a power source 9 while a pressure is being applied to the sintering raw material. A sintering temperature is controlled by a controller 11 while the temperature of the die 2 is being monitored by a thermocouple 10.

When pulse electricity is applied, a high speed diffusion effect is generated by high speed movement of ions caused by the electric field. By applying the voltage and the current repeatedly by this ON-OFF operation, since discharge points and Joule heat generation points (local high temperature-generation points) are moved in the sintering raw material and entirely distributed therein, the phenomenon and the effect obtained in the ON-state are uniformly repeated in the sintering raw material, and as a result, efficient sintering is performed in a solid phase with a small power consumption.

Figure 3:
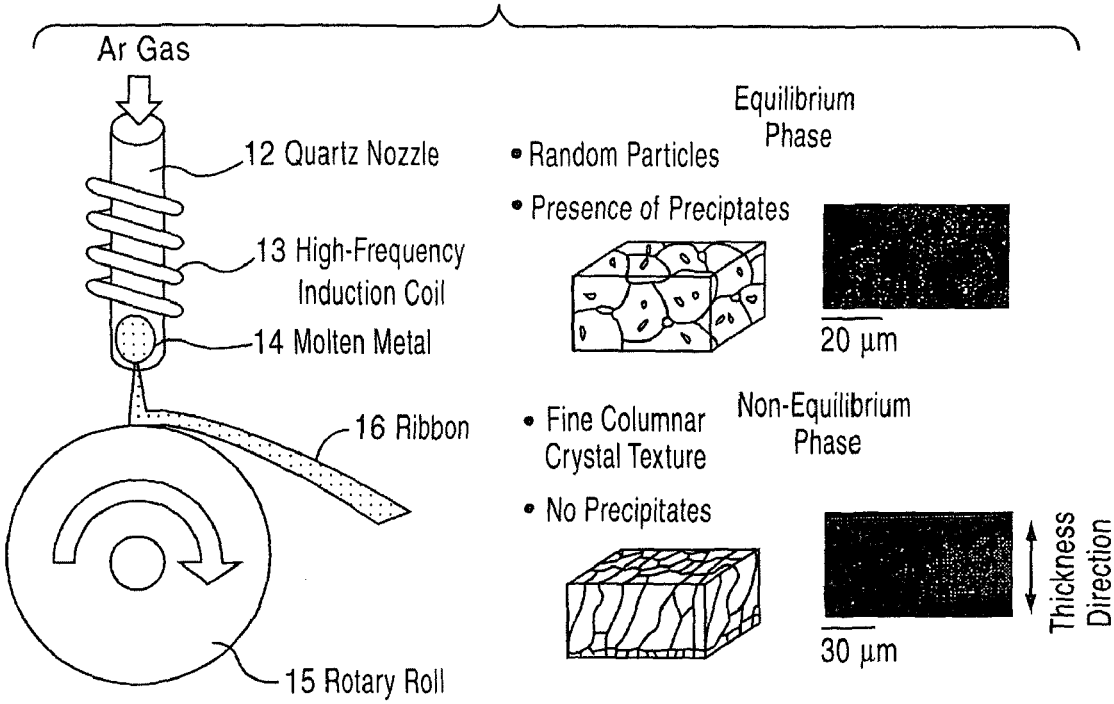
FIG. 3 is a schematic view showing the difference of a Fe—Ga magnetostrictive alloy texture between a rapidly solidified thin belt material composed of a non-equilibrium phase and a heat-treated material composed of an equilibrium phase after melt processing.

The case in which a Fe—Ga magnetostrictive alloy is produced by the above method will be described in more detail. In FIG. 3, as for a Fe—Ga alloy, the difference is shown between a thin belt material and a metal texture, the thin belt material being composed of a representative metastable phase (no precipitation phase) formed by a rapid solidification method, and the metal texture (Fe—$Ga_3$, $LI_2$, $DO_3$ ordered phase precipitation) being in accordance with a phase equilibrium diagram, which is obtained by performing general melting and processing, followed by annealing. The liquid rapidly solidified thin belt material is obtained as shown in FIG. 3 such that a molten metal 14 formed by heating and melting a raw material in a quartz crucible 12 by a high-frequency induction coil 13 is ejected by an Ar gas onto a high speed rotation surface of a rotary roll 15 to form a ribbon 16.

By the liquid rapid solidification method, a phase which generally appears only at a high temperature is first allowed to appear at room temperature by rapid solidification performed from a liquid phase. Second, at an intermediate cooling rate, a fine columnar crystal texture is formed. Since this texture is finer than a conventional polycrystalline material, it has a high strength, and since the thermal flow direction in solidification is along one axis, an anisotropic texture having strong orientation in that direction can be obtained. In a Fe—Ga alloy, when the magnetic anisotropy is controlled, a functional material having superior energy efficiency can be obtained.

In a Fe—Ga alloy, a $Fe_{100-x}Ga_x$ single crystal obtained by a general melting and processing method has a disordered bcc structure when x is 19 atomic percent or less, and the magnetostrictive constant is increased to 20 times that of Fe. Furthermore, when those single crystals are rapidly solidified from a high temperature, the magnetostrictive constant is further increased. However, it was reported that in an alloy in which x is 20 atomic percent or more, the magnetostrictive constant (saturated magnetostriction) is decreased (authored by T. A. Lograsso, A. R. Ross, D. L. Shlagel, A. E. Clark, and M. Wun-Fogel, "J. Alloys and Compounds" 35095-101 (2003)).

The change in the saturated magnetostriction of a Fe—Ga alloy with the change in composition will be described. According to the Ga concentration dependence of the magnetic moment per atom of a bcc Fe—Ga alloy (authored by N. Kawamiya, K. A. Adachi, and Y. Nakamura "J. Physics Soc. Japan. 33. 1218-1327, 1972), up to approximately 15 atomic percent of Ga, the change is as if Fe is simply diluted with Ga. At the Ga concentration more than the above, the change becomes different from the simple dilution behavior, and at a Ga concentration of 20 atomic percent or more, as the ordering proceeds, the saturated magnetostriction is rapidly decreased. The reason for this is believed that when Fe is being surrounded by Ga, the magnetic moment of Fe itself is decreased. In addition, the ordered structure formation also begins to relate to the change in spontaneous magnetization.

Furthermore, according to the phase equilibrium diagram (not shown), the crystal structure is changed from a disordered bcc phase to ordered phases (DO3, L12) at approximately 700° C. in a region at a Ga concentration of 20 atomic percent or more, and hence it is believed that this structural change relates to the magnetostrictive value. Accordingly, when a high-temperature disordered bcc phase is frozen to room temperature by a liquid rapid solidification method without precipitating ordered phases of a Fe—Ga alloy, a larger magnetostriction can be expected.

Accordingly, it is important that alloy thin belts be formed by rapid solidification method and laminated to each other without performing any modification, followed by spark plasma sintering, the alloy thin belts having a high temperature-side disordered bcc structure and a fine columnar texture, those are not formed by a general melting and processing method, being in a disordered to ordered transition composition range, and containing 15 to 23 atomic percent of Ga with respect to polycrystalline Fe.

When the application forces by the upper and lower punches and the sintering temperature in spark plasma sintering are changed, the magnetic and magnetostrictive properties of a sintered material are changed. In order to complete the sintering while maintaining a fine crystal texture formed by the liquid rapid solidification method, it is preferable that in the spark plasma sintering, the pressure be increased as high as possible and that the sintering be performed at a low temperature. A Fe-17 at % Ga alloy thin belt can be sintered at an application pressure of 50 MPa or more and a sintering temperature of 873K or more during spark plasma sintering. The ratio of the density of a sample sintered under 100 MPa at 973K is approximately 100%.

When the material sintered under 100 MPa at 973K was annealed for a short period of time, a magnetostriction of 170 to 230 ppm was obtained at room temperature. When annealing in a magnetic field is performed after sintering, the crystal orientation of the alloy properties can be enhanced, and in addition, the magnetic moment (magnetic domain structure) directly relating to the magnetostriction can be controlled. When the above sample was processed by annealing in a magnetic field after the sintering, the magnetostriction was increased to 250 to 260 ppm. The reason for this is believed that the magnetic (domains) structures which move and rotate and which are responsible for the magnetostriction generation mechanism are aligned in a magnetic field processing direction at a nano to a meso level, and as a result, the magnetic rotation is promoted at a micron level with respect to external magnetic field application, so that the magnetostriction is promoted.

From the results described above, it is preferable that in order to obtain a large magnetostriction, the texture peculiar to a liquid rapidly solidified thin belt be not changed, and in addition, in order to sufficiently bonds thin belts to each other, the application pressure and the sintering temperature be set to 50 MPa or more and 873K or more, respectively. The upper limit of the application pressure and that of the sintering temperature must be determined so as not to lose the texture of the rapidly solidified material.

Besides the properties of the liquid rapidly solidified material before spark plasma sintering, pulverization conditions of the material also has influence on the properties of a bulk alloy. Alcohol-wet milling is effective to maintain the properties of a rapidly solidified material.

Example 1

A Fe-17 at % Ga alloy ingot was formed by melting electrolytic iron and Ga by a plasma arc melting method. This ingot was melt and was formed into a thin belt 2 m long, 5 mm wide, and 80 μm thick in an argon atmosphere by a liquid rapid solidification (single roll) method. This thin belt was cut into slices 40 mm long to be used for a discharge plasma sintering sample.

After 300 slices were stacked together in a cemented carbide alloy die, sintering was performed for Sample (a) under 50 MPa at 973K, Sample (b) under 100 MPa at 973K, and Sample (c) under 300 MPa at 873K, and the sintering time was set to 5 minutes. As a spark plasma sintering apparatus, SPS 1050 manufactured by Sumitomo Coal Mining Co., Ltd. was used. The spark plasma sintering was performed at a vacuum degree of 2 Pa, a current of 3,000 A, and a voltage of 200 V. The temperature rising conditions were different depending on the temperature; however, it was approximately 30 minutes. The size of the sample after the sintering was 40 mm long, 5 mm wide, and 9 mm thick (in the direction perpendicular to the surface of the thin belt). For comparison purposes, a sample (equivalent to that described in Non-Patent Document 2) was prepared which was obtained by annealing an as-rapidly-solidified Fe-15 at % Ga alloy thin belt at 1,173K for 0.5 hours.

<X-Ray Structure Analysis>

Figure 4:
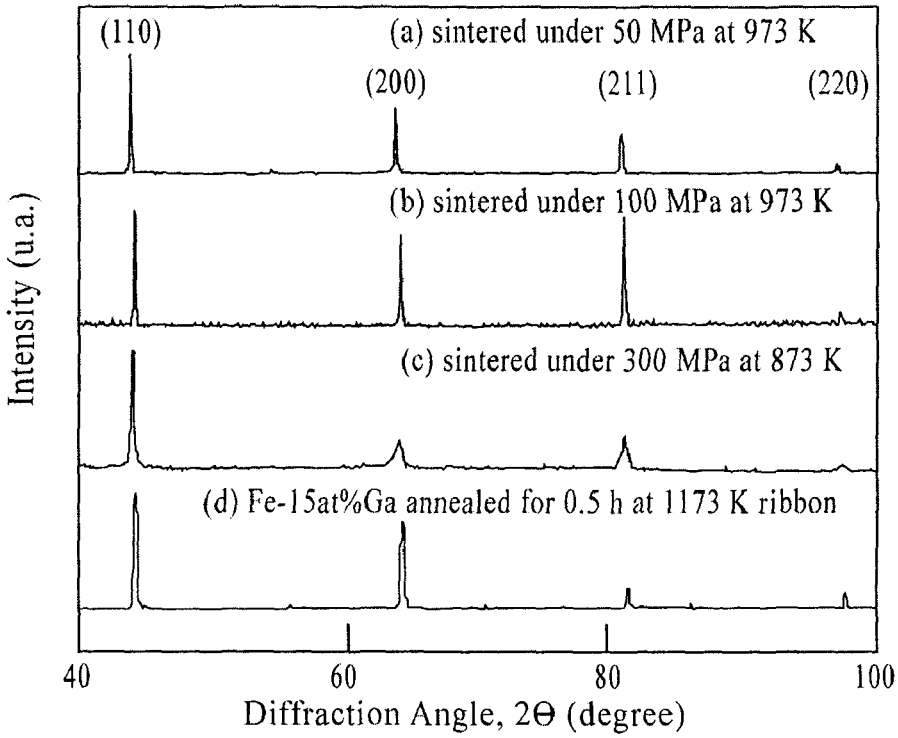
FIG. 4 includes x-ray diffraction patterns of a Fe-17 at % Ga alloy sintered sample and a Fe-15 at % Ga thin-belt alloy sample.

The analysis of the crystal structure of each sintered sample was performed by analyzing the peak of the CuKa1 line using an X-ray diffraction method. FIG. 4 shows X-ray diffraction patterns of Samples (a), (b) and (c), which were the sintered samples of the Fe-17 at % Ga alloy, and Sample (d) of a comparative example. The three types of sintered samples are formed of a body-centered cubic structure having a lattice constant of 0.2904 nm. The intensity of the (200) peak of Sample (b), the sample sintered under 100 MPa at 973K, is strong as compared to that of the other sintered samples and is similar to the diffraction pattern of Sample (d) of the comparative example having a strong [100] orientation. This result indicates that in Sample (b), the [100] texture of the thin belt is maintained.

Since Sample (a), the sample sintered under 50 MPa at 973K, has the (200) peak although it is weaker than that of Sample (b), the sample sintered under 100 MPa at 973K, the texture is maintained. On the other hand, the (200) peak of Sample (c), the sample sintered under 300 MPa at 873K, is small and spread, and hence the texture of the thin belt is lost. The reason for this is believed that an application pressure of 300 MPa causes plastic deformation and internal damage.

<Magnetization and Magnetostriction Measurement>

Figure 5:
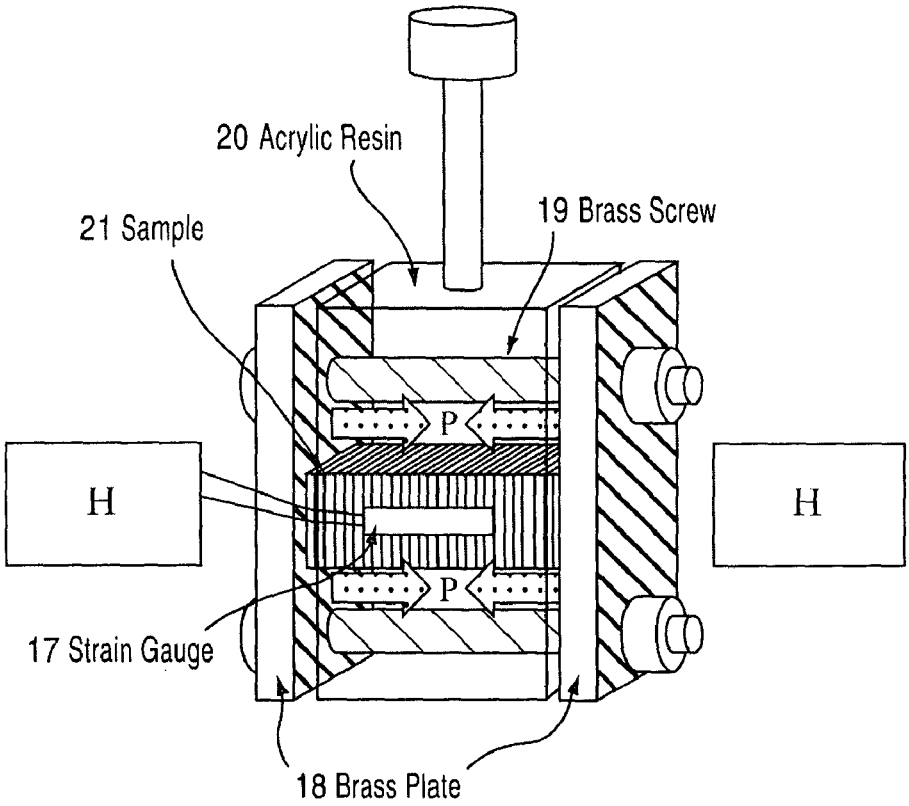
FIG. 5 is a schematic view showing a magnetostriction measurement method.

For the magnetization measurement, by using a vibrating sample magnetometer (VSM), a magnetization-magnetic field hysteresis curve (M-H loop) was measured at a maximum magnetic field of 10 kOe. Furthermore, as shown in FIG. 5, by using a measurement device formed of 2 brass plates 18, brass screws 19, and an acrylic resin 20, strain gauges 17 were adhered to a sample 21, and the magnetostriction parallel to the thickness direction was measured.

A compressive stress of 20 MPa, 60 MPa, or 100 MPa was applied to the sample as a pre-stress, and the magnetostrictive value was determined by the average of the values obtained by the strain gauges 17 provided on the front and the rear surface of the sample. For the magnetization and the magnetostriction measurement, a Fe-17 at % Ga alloy sintered sample was cut to have a length of 2.7 mm, a width of 5 mm, and a thickness (in the direction perpendicular to the surface of the thin belt) of 9 mm. Since it has been reported (Non-Patent Document 2) that when a magnetic filed is applied perpendicularly to the surface of a thin belt, a large magnetostriction is obtained, a magnetic field H was applied in the direction as described above also in this example. The saturated magnetization was 1.68 Tesla and was hardly changed even when the pre-stress was changed.

Figure 6:
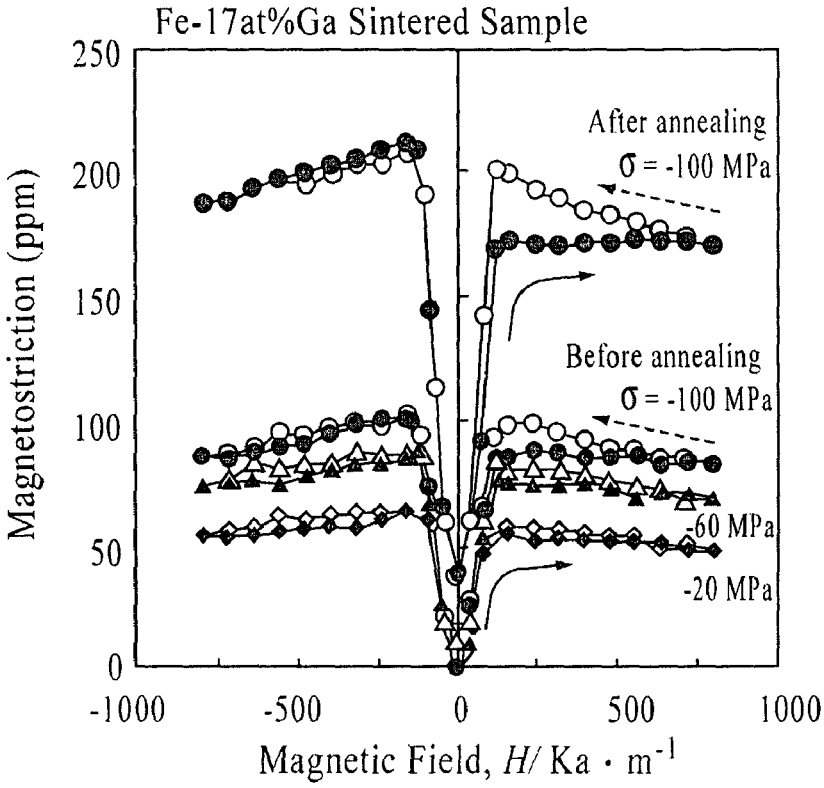
FIG. 6 is a graph showing the magnetostriction (compressive strength $\sigma$ dependence) of a Fe-17 at % Ga alloy sintered (under 100 MPa at 973K) sample and a magnetostrictive increase phenomenon after annealing.

FIG. 6 shows the magnetostriction of Sample (b), which is the sample sintered under 100 MPa at 973K. The magnetostriction considerably depends on a pre-stress s, is saturated at a low magnetic field of 2 kOe, and is then slightly decreased to the original value as H is increased. A maximum magnetostriction of 100 ppm was obtained when a pre-stress s of 100 MPa was applied. The maximum magnetostriction of Sample (a), the sample sintered under 50 MPa at 973K, was 70 ppm and was smaller than that of Sample (b), which is the sample sintered under 100 MPa at 973K. The reason for this is believed that since the stress in sintering was excessively small, bonds between the thin belts were not sufficiently formed. Furthermore, since Sample (c), the sample sintered under 300 MPa at 873K, had a random texture, the magnetostriction thereof was smallest.

Example 2

Figure 7:
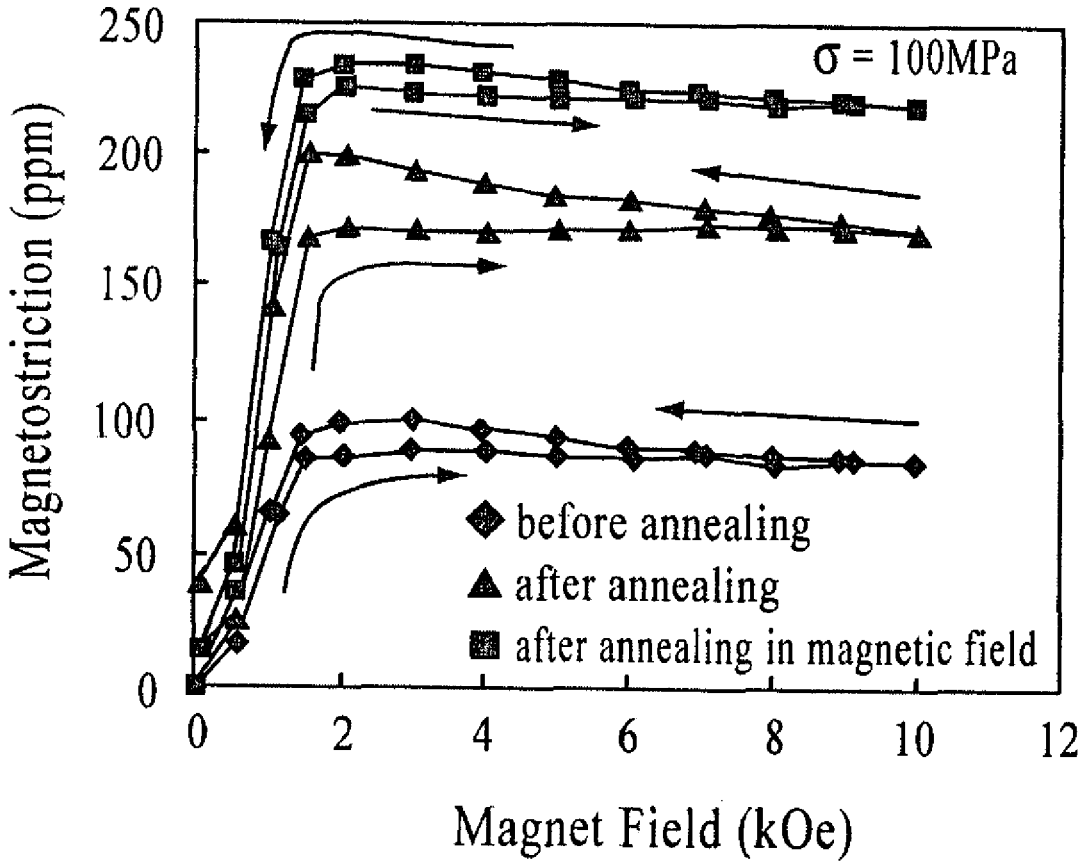
FIG. 7 is a graph showing a magnetostrictive increase phenomenon (shown by black squares, at a compressive stress $\sigma$=100 MPa) after annealing of a Fe-17 at % Ga alloy sintered (under 100 MPa at 973K) sample, followed by annealing in a magnetic field (400° C., H=0.5 Tesla, 15 minutes).

Sample (b), the sample sintered under 100 MPa at 973K, produced by the method described in Example 1 was annealed at 1,173K for 1 hour in a vacuum atmosphere. After the annealing, the magnetostriction was measured. FIG. 7 is a graph showing the magnetostrictions of the sintered sample before and after the annealing. The magnetostrictions before and after the annealing at H of 2 kOe were 100 ppm and 170 to 230 ppm, respectively, and it was found that the magnetostriction was increased by the annealing. Furthermore, when annealing in a magnetic field was performed after the sintering, the magnetostriction was increased to 250 to 260 ppm. The reason the magnetostriction is increased when the thin belt sample is annealed for a short period of time is believed that the [100] orientation is enhanced so that the magnetostriction is increased [see Non-Patent Document 2], and in addition, it is also believed that the magnetic moments (magnetic domain structures) directly relating to the magnetostriction which are aligned in a specific direction by application of an external magnetic field also relate to this increase in magnetostriction.

INDUSTRIAL APPLICABILITY

As for application of the rapidly solidified materials consolidated into a bulk form of the present invention as a magnetostrictive material, magnetic sensors and magnetostrictive actuators (drive devices) are typically mentioned. As particular examples of the actuator sensors made from the magnetostrictive material, for example, a submerged sonar device (sound locator), fish detector, active damping device, acoustic speaker, engine fuel injection valve, electromagnetic brake, micro-positioner, fluid control (gas and liquid) valve, electric toothbrush, vibrator, and dental cutting and vibrating therapeutic device may be mentioned, and in addition, an automobile torque sensor, electric automobile torque sensor, sensor shaft, strain sensor, security sensor and the like may also be mentioned. Besides, there have been developed insulated magnetic particles and silicon steel to overcome an eddy-current loss in dynamic operation of a magnetostrictive material, and magnetostrictive composite materials using a non-electric conductive material.

What is claimed is:

1. A method for producing a giant magnetostrictive alloy for actuators and sensors, comprising the steps of:

forming a rapidly solidified material by a liquid rapid solidification method, wherein the material is a polycrystalline Fe—Ga alloy having a high temperature-side disordered bcc structure and a fine columnar texture, being in a disordered to an ordered transition composition range, and containing 15 to 23 atomic percent of Ga;

forming slices, or a powder from the alloy as a raw material; and performing spark plasma sintering of the raw material at an application pressure of 50 MPa or more and at a sintering temperature of 873K or more under conditions in which the pressure and the temperature are controlled so that the texture of the rapidly solidified material is not lost.

2. The method for producing a giant magnetostrictive alloy for actuators and sensors, according to claim 1, wherein annealing is performed after the sintering to obtain a magnetostriction of 170 to 230 ppm at room temperature.

3. The method for producing a giant magnetostrictive alloy for actuators and sensors, according to claim 2, wherein the crystal orientation of alloy properties is enhanced by annealing in a magnetic field after the sintering, and the magnetic moment (magnetic domain structure) directly relating to the magnetostriction is controlled.

* * * * *